US007036499B2

(12) United States Patent
Bartmann et al.

(10) Patent No.: US 7,036,499 B2
(45) Date of Patent: May 2, 2006

(54) HOUSEHOLD APPLIANCE AND HOUSEHOLD APPLIANCE DOOR

(75) Inventors: Frank Bartmann, Hambrücken (DE); Jochen Herbolsheimer, Bretten (DE); Horst Krenz, Bretten-Ruit (DE); Heiko Meyer, Walzbachtal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/928,224

(22) Filed: Aug. 27, 2004

(65) Prior Publication Data

US 2005/0034381 A1 Feb. 17, 2005

Related U.S. Application Data

(63) Continuation of application No. PCT/EP03/01454, filed on Feb. 13, 2003.

(30) Foreign Application Priority Data

Feb. 27, 2002 (DE) ..... 102 08 457

(51) Int. Cl.
*F24C 15/04* (2006.01)

(52) U.S. Cl. ..... 126/191; 126/273 R; 312/326

(58) Field of Classification Search ..... 126/191, 126/197, 192, 194, 273 R, 19 R; 16/110.1, 16/412; 292/216, 198, 229, DIG. 69; 312/319.3, 312/323, 326

See application file for complete search history.

(56) References Cited

U.S. PATENT DOCUMENTS

| | | | | | |
|---|---|---|---|---|---|
| 1,801,190 | A | * | 4/1931 | Cuffe | 126/191 |
| 1,969,197 | A | * | 8/1934 | Barker | 126/190 |
| 2,925,081 | A | * | 2/1960 | Shooter | 126/190 |
| 3,127,889 | A | * | 4/1964 | Mills | 126/194 |

FOREIGN PATENT DOCUMENTS

| | | | | |
|---|---|---|---|---|
| DE | 1 800 425 | | | 11/1959 |
| DE | 27 40 462 | A | * | 3/1979 |
| DE | 39 35 803 | A1 | * | 5/1991 |
| DE | 199 06 913 | A1 | | 8/2000 |
| EP | 0 659 960 | A2 | | 6/1995 |
| GB | 2 183 152 | A | * | 6/1987 |
| JP | 10-185198 | | * | 7/1998 |
| WO | 02/059528 | A1 | | 8/2002 |

* cited by examiner

*Primary Examiner*—Josiah C. Cocks
(74) *Attorney, Agent, or Firm*—John T. Winburn; Russell W. Warnock; Craig J. Loest

(57) ABSTRACT

Household devices that a useful compartment and can be closed by a door provided with a door handle include a storage compartment into which the door can be displaced by guiding system and at least one guiding element associated with the door and guided in a sliding track associated with the household appliance. To be able to operate the door in an ergonomically favorable manner, at least one control mechanism is associated with the door handle. When the door pivots in a first pivoting direction, the control mechanism pivots the door handle in a second pivoting direction counter to the first pivoting direction.

27 Claims, 12 Drawing Sheets

HOUSEHOLD APPLIANCE AND HOUSEHOLD APPLIANCE DOOR

CROSS-REFERENCE TO RELATED APPLICATION

This application is a continuation, under 35 U.S.C. § 120, of copending international application No. PCT/EP03/01454, filed Feb. 13, 2003, which designated the United States; this application also claims the priority, under 35 U.S.C. § 119, of German patent application No. 102 08 457.2, filed Feb. 27, 2002; the prior applications are herewith incorporated by reference in their entirety.

BACKGROUND OF THE INVENTION

1. Field of the Invention

The present invention relates to a household appliance having a useful space, which can be closed by a door having a door handle and a storage space into which the door can be displaced by a guide system. The guide system has at least one guide element that is associated with the door and is guided in a slotted-guide track associated with the household appliance.

German Published, Non-Prosecuted Patent Application DE 199 06 913 discloses a household appliance of the generic type having a door that closes a useful space in the household appliance.

An opening having a guide system disposed in it is formed in a horizontal plane below the useful space. The door can be slid into the opening through the guide system.

SUMMARY OF THE INVENTION

It is accordingly an object of the invention to provide a household appliance and household appliance door that overcomes the hereinafore-mentioned disadvantages of the heretofore-known devices of this general type and that can be operated in an ergonomically favorable manner.

With the foregoing and other objects in view, there is provided, in accordance with the invention, a household appliance, including a body defining a useful space, a storage space, and a door opening, a door pivotally connected to the body and selectively opening and closing off the door opening, the door having a door handle and a first pivoting direction, at least one control mechanism operatively connected to the door handle to, during a pivoting of the door in the first pivoting direction, pivot the door handle in a second pivoting direction opposite to the first pivoting direction, a guide system having a slotted-guide track connected to the body and at least one guide element operatively associated with the door and guiding the door in the slotted-guide track, and the guide system guiding the door into and out from the storage space.

The door handle is associated with at least one control mechanism that, during a pivoting of the door in a first pivoting direction, pivots the door handle in a second pivoting direction opposed to the first pivoting direction. As a result, a spatial alignment of the door handle substantially regardless of a pivoting position of the door can be retained. The door handle can, therefore, always be aligned toward an operator regardless of a pivoting position of the door. In the open state of the door, it is, therefore, no longer required to grip around the edge of the door to reach the door handle.

In accordance with another feature of the invention, the control mechanism interacts directly with the guide element of the door to transmit a driving movement of the control mechanism. A movement of the guide element in the slotted-guide track can, therefore, serve as a driving movement for the control mechanism.

In accordance with a further feature of the invention, the guide element can be realized by a guide roller that rolls when displaced in the slotted-guide track and transmits a rotational movement to the control mechanism.

Instead of the abovementioned rotational movement, in accordance with an added feature of the invention, the guide element can be mounted pivotally in relation to the door. During a movement in the slotted-guide track, a pivoting movement, therefore, takes place between the guide element and the door and is transmitted as a driving movement to the control mechanism.

In accordance with an additional feature of the invention, the control mechanism can have a driving part that transmits a movement, for example, a pivoting movement or a rotational movement, to the control mechanism.

In accordance with yet another feature of the invention, to transmit a pivoting movement, which serves as a driving movement, to the control mechanism, the guide element has an adjusting lever. The adjusting lever is in a form-fitting connection with the driving part of the control mechanism. As a result, the guide element is connected pivotally in relation to the control mechanism in the manner of a hinge.

In accordance with yet a further feature of the invention, the control mechanism can, advantageously, be associated with an adjustable locking element that can be adjusted between a locking position and a release position. In the release position, the locking element can release the form-fitting connection between the driving part of the control mechanism and the guide element. As a result, the door can be removed in a simple manner from the household appliance for cleaning.

In accordance with yet an added feature of the invention, to achieve an opening or closing movement of the door that is ergonomically favorable for the operator, in addition to the mounting in the slotted-guide tracks, the door is mounted pivotally about a hinge pin, which is fixed on the housing. Because the hinge pin is configured such that it is fixed on the housing, a structural outlay caused as a result is small—in comparison with a moving hinge pin.

In accordance with yet an additional feature of the invention, the slotted-guide track has a slide-in section in which the door is guided in a substantially horizontal plane. By the slide-in section, a horizontal movement of the door can be achieved. A guiding of the door into the storage space or out of the storage space is, therefore, made possible for the operator in a simple and ergonomically favorable manner.

In accordance with again another feature of the invention, to obtain a horizontal movement of the door that is ergonomically particularly advantageous for the operator, the hinge pin, which is fixed on the housing, is disposed substantially level with the slide-in section of the slotted-guide track.

In accordance with again a further feature of the invention, the control mechanism has, firstly, a spring that prestresses the door handle in one of its pivoting directions and exerts a first torque on the door handle. Secondly, the control mechanism has a movement-transmitting device. The movement-transmitting device exerts—as a function of the pivoting movement of the door—a second torque on the door handle, which torque acts counter to the first torque. A control mechanism of this type is structurally simple and can be produced cost effectively.

The control mechanism has, to exert the first and/or second torque, a first and/or second tension element that engages on the door handle at a distance from the door handle spindle through a first and/or second lever arm length.

In accordance with again an added feature of the invention, the door handle has a door handle spindle and the control mechanism has, to exert the first torque, a first tension element connecting the spring element to the door handle and engaging on the door handle at a distance from the door handle spindle through a first lever arm length.

In accordance with again an additional feature of the invention, the control mechanism has, to exert the second torque, a second tension element engaging on the door handle at a distance from the door handle spindle through a second lever arm length.

In accordance with still another feature of the invention, it may be advantageous for the first and/or second lever arm length to change as a function of a pivoting position of the door handle. During an opening process of the door from the closed position, an initially large lever arm length can increase the torque exerted on the door handle. As a result, driving losses during an initial tensile loading, for example, a stretching of the tension elements of the control mechanism, can be compensated for.

In accordance with still a further feature of the invention, at least one of the first and second lever arm lengths is constant regardless of a pivoting position of the door handle.

In accordance with still an added feature of the invention, the control mechanism can, advantageously, have at least one deflecting roller that defines the course of the tension elements. As a result, a course of the tension element connected to the door handle can be deflected in any desired manner without transmission losses due to friction, etc. having to be accepted. For example, the tension element can be connected to a tension spring disposed at a distance from the bearing housing. In such a case, location, position and size of the spring can be adapted in accordance with the requirements.

In accordance with still an additional feature of the invention, the door handle can be associated with, in a rotationally fixed manner, a radial cam. First and second tension elements are guided in opposite directions through the radial cam and exert the previously mentioned, opposed first and second torques on the door. The radius of the radial cam can be adapted in accordance with the required lever arm length.

In an alternative refinement, the control mechanism can have a tension element that is closed in the form of a loop and loops firstly around the driving part and secondly around the radial cam of the door. As a result, a rotational movement of the driving part can be transmitted in a technically simple and effective manner to the radial cam of the door. The tension element that is closed in the form of a loop permits a particularly cost effective and efficient transmission between the driving part and the radial cam.

The operability of the abovementioned control mechanism is increased if an additional tightening device is provided and tightens the tension element, which is closed in the form of a loop. A spring inserted in the loop of the tension element can serve as the tightening device.

To avoid a tilting of the door in the slotted-guide track during an opening and closing movement, one of the control mechanisms is provided respectively on the two narrow sides of the door, which sides lie opposite each other in the axial direction. The control mechanisms provided on both sides of the door permit a synchronous and smooth-running pivoting of the door handle.

In accordance with a concomitant feature of the invention, the household appliance door is a cooking appliance door.

Other features that are considered as characteristic for the invention are set forth in the appended claims.

Although the invention is illustrated and described herein as embodied in a household appliance and household appliance door, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
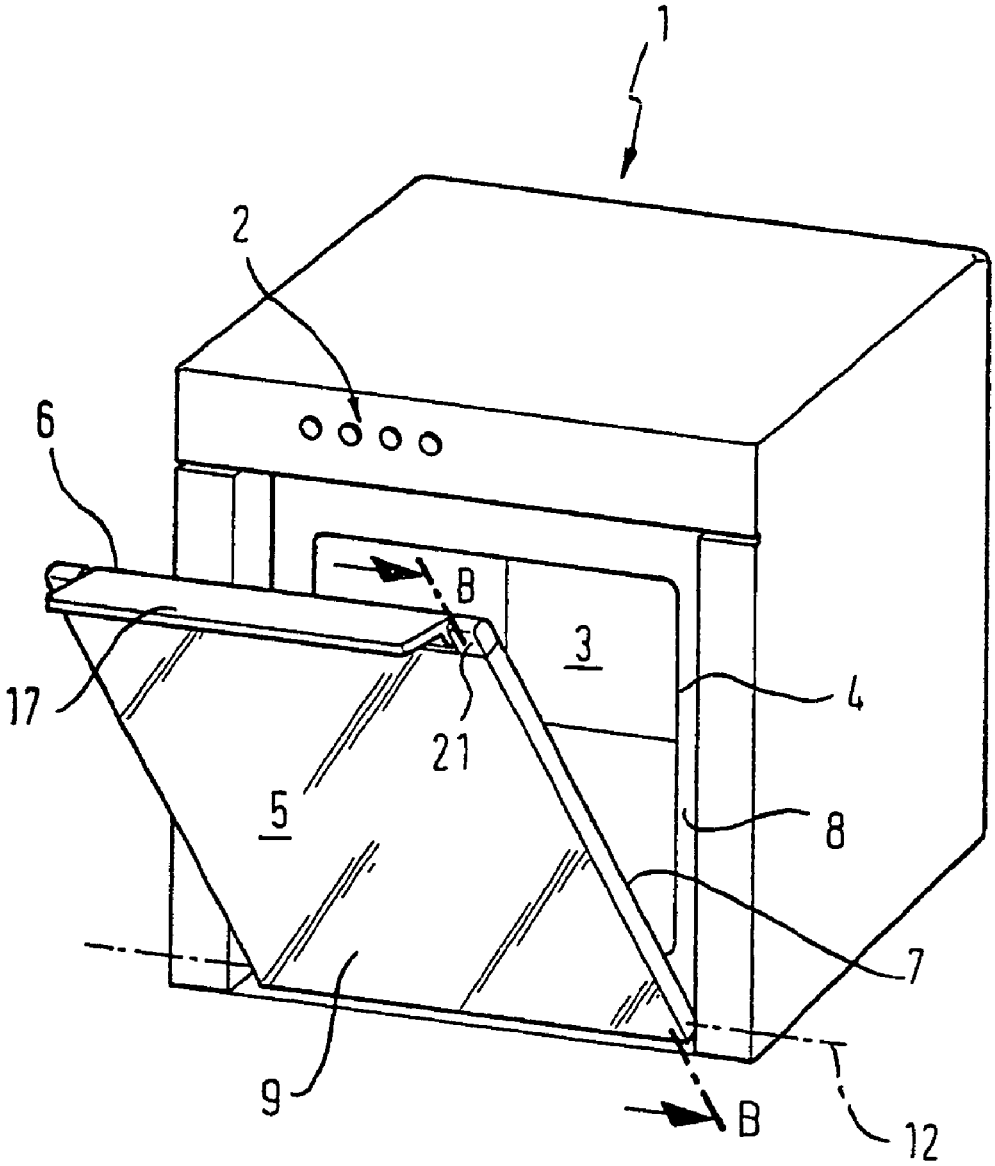
FIG. 1 is a perspective front view of a first exemplary embodiment of a cooking appliance according to the invention with an opened door.

Referring now to the figures of the drawings in detail and first, particularly to FIG. 1 thereof, there is shown a cooking appliance 1 in a first exemplary embodiment of a household appliance according to the invention. The cooking appliance 1 has front-side operating and display elements 2 with an associated non-illustrated control unit. Furthermore, a cooking space 3 is provided in the cooking appliance 1. The cooking space 3 is bounded by a muffle 4 that is open on the front side. A front-side muffle frame 8 frames the front-side opening of the muffle 4. The cooking space 3 can be closed by a door 5 that is mounted pivotally about a horizontal hinge pin or articulation axis 12. The door 5 has an inner door window 7 and an outer door window 9 of glass or glass ceramic. A door handle 17, which is mounted pivotally in a bearing housing 21, is provided on an upper end side 6 of the door 5.

Figure 2:
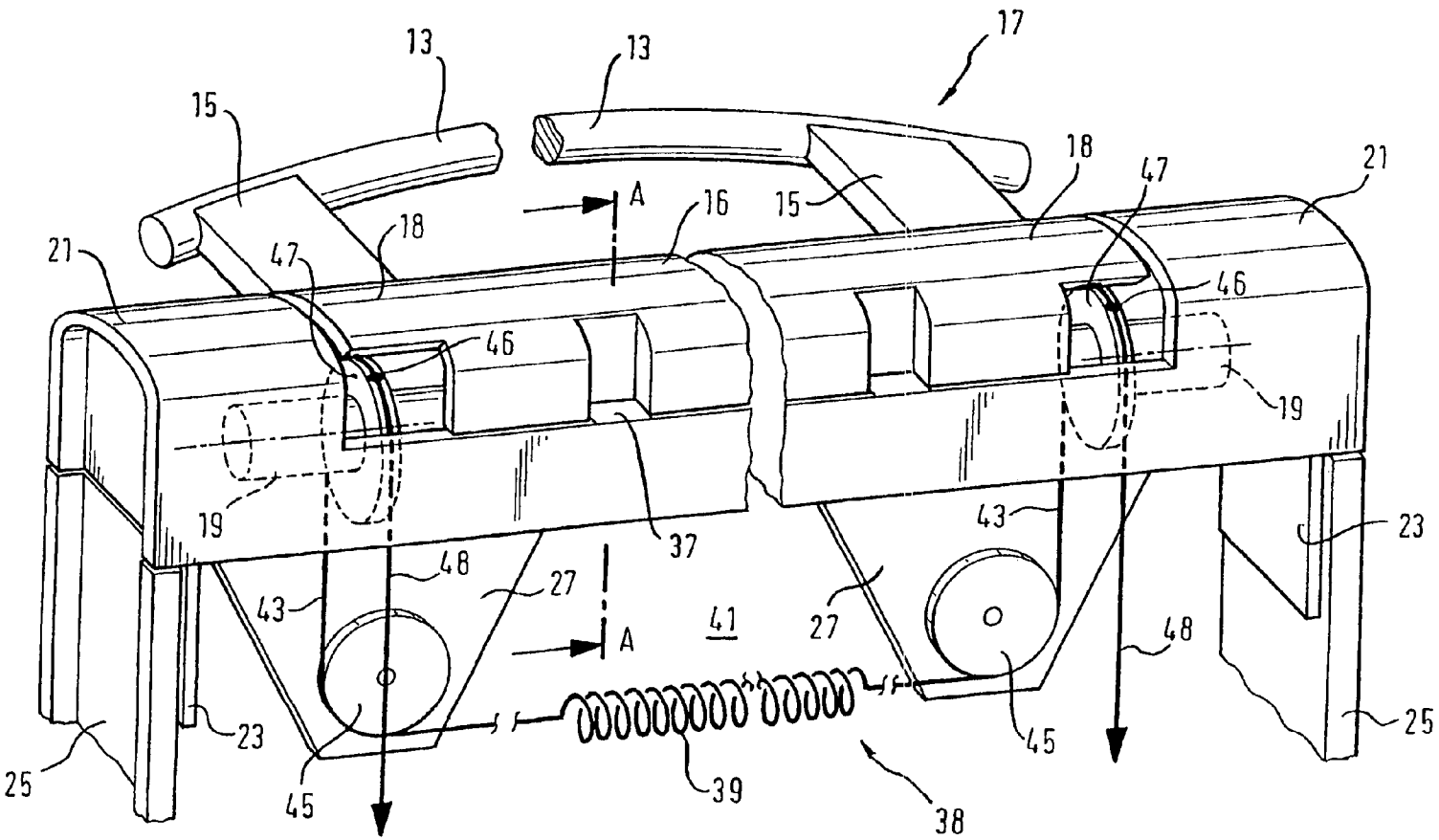
FIG. 2 is a fragmentary, enlarged perspective and partially hidden view of a cutout of a door handle according to the invention with an associated bearing housing.

FIG. 2 shows the configuration including the door handle 17 and the bearing housing 21 in a perspective illustration enlarged in some sections. For simplification purposes, the inner and outer door windows 7, 9 of the door are omitted. The door handle 17 has a handle strip 13 that is connected to a pivoting part 16 through bearing blocks 15. The pivoting part 16 forms the upper end side 6 of the door 5 and has pivot pins 19 on both sides in the longitudinal direction. The pivot pins 19 are mounted rotatably in the bearing housing 21. Both the bearing housing 21 and the pivoting part 16 are, preferably, manufactured as an injection molded part from a duroplastic (thermosetting plastic material). Stiffening elements 23 are formed on both longitudinal sides of the bearing housing 21. These stiffening elements 23 dip into an inner space 41 of the door and are fastened releasably, for example, screwed, to lateral edge strips 25 of the door 5.

Figure 3:
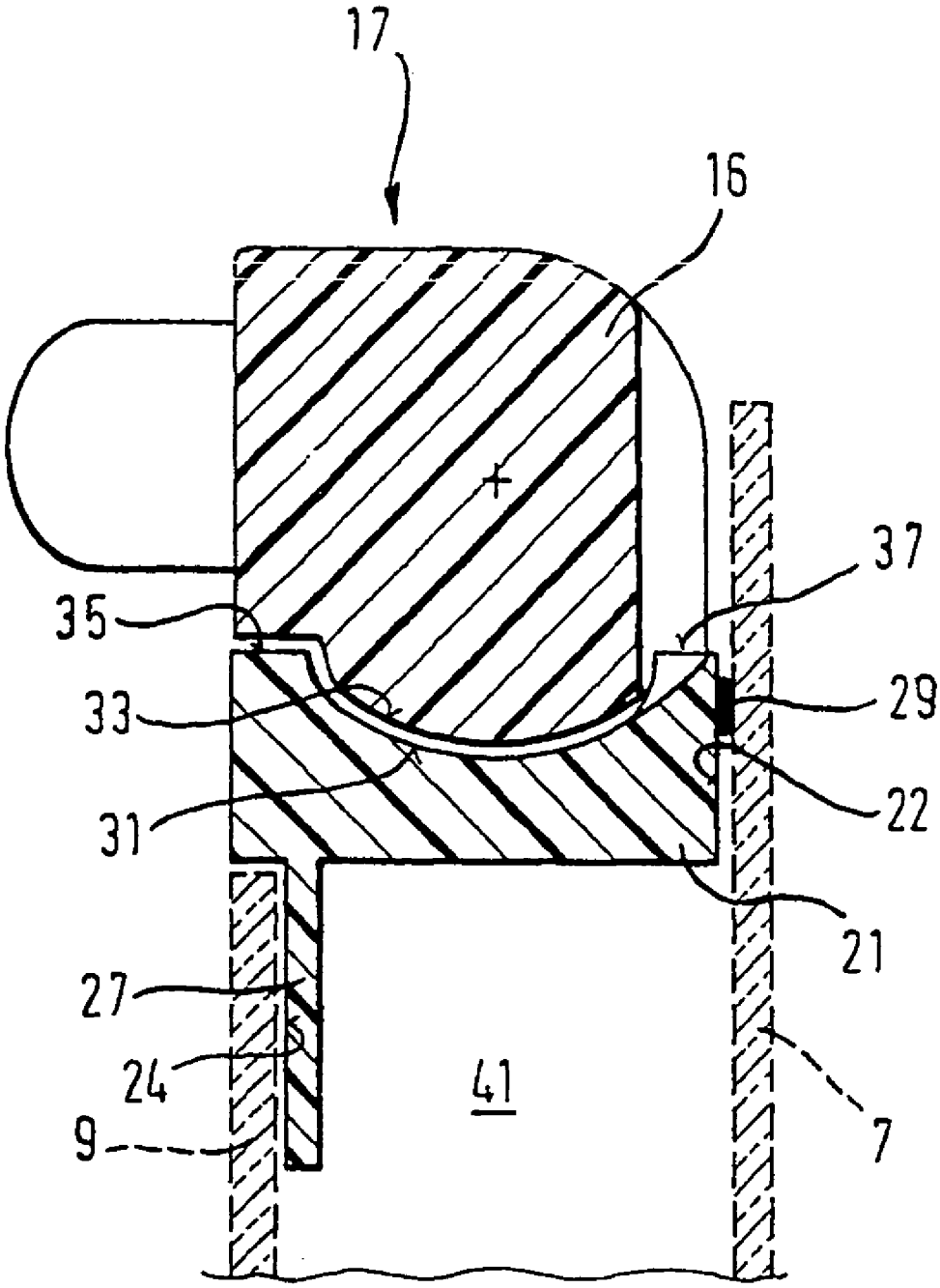
FIG. 3 is a fragmentary, side cross-sectional view of the handle of FIG. 2 along section line A—A.

Additional stiffening elements 27 are formed on the front side of the bearing housing 21. According to FIG. 3, the stiffening elements 27 are in contact with the outer door window 9. FIG. 3 shows a sectional illustration along the line A—A from FIG. 2, in which the door windows 7, 9 are indicated in dashed lines. Accordingly, the stiffening element 27 is in contact with the outer door window 9 while the inner door window 7 rests, with the interposition of a seal 29, against a contact surface 22 of the bearing housing 21. FIG. 3, furthermore, reveals that the bearing housing 21 has a supporting surface 31. The supporting surface 31 is disposed between the lateral pivot pins (journals) 19 and extends in the axial direction of the pivoting part 16 over virtually the entire length of the pivoting part 1. A corresponding mating surface 33 of the pivoting part 16 is in contact with the supporting surface 31. During the pivoting movement of the door handle 17, the pivoting part 16 thereof is, therefore, supported on the supporting surface 31. Furthermore, two stops 35, 37 that restrict and bound a pivoting region of the door handle 17 are formed on the bearing housing 21.

As illustrated in FIG. 2, the door handle 17 is associated with a tension spring 39 that pre-stresses the door handle 17 in a pivoting direction. The tension spring 39 is provided below the bearing housing 21 and extends in the longitudinal direction of the bearing housing 21. The tension spring 39 is suspended freely in the inner space 41 of the door that is formed between the door windows 7, 9. The freely suspended configuration of the tension spring 39 within the inner space 41 of the door makes it possible to achieve a free expansion and, therefore, low-wear loading of the tension spring 39.

Figure 4:
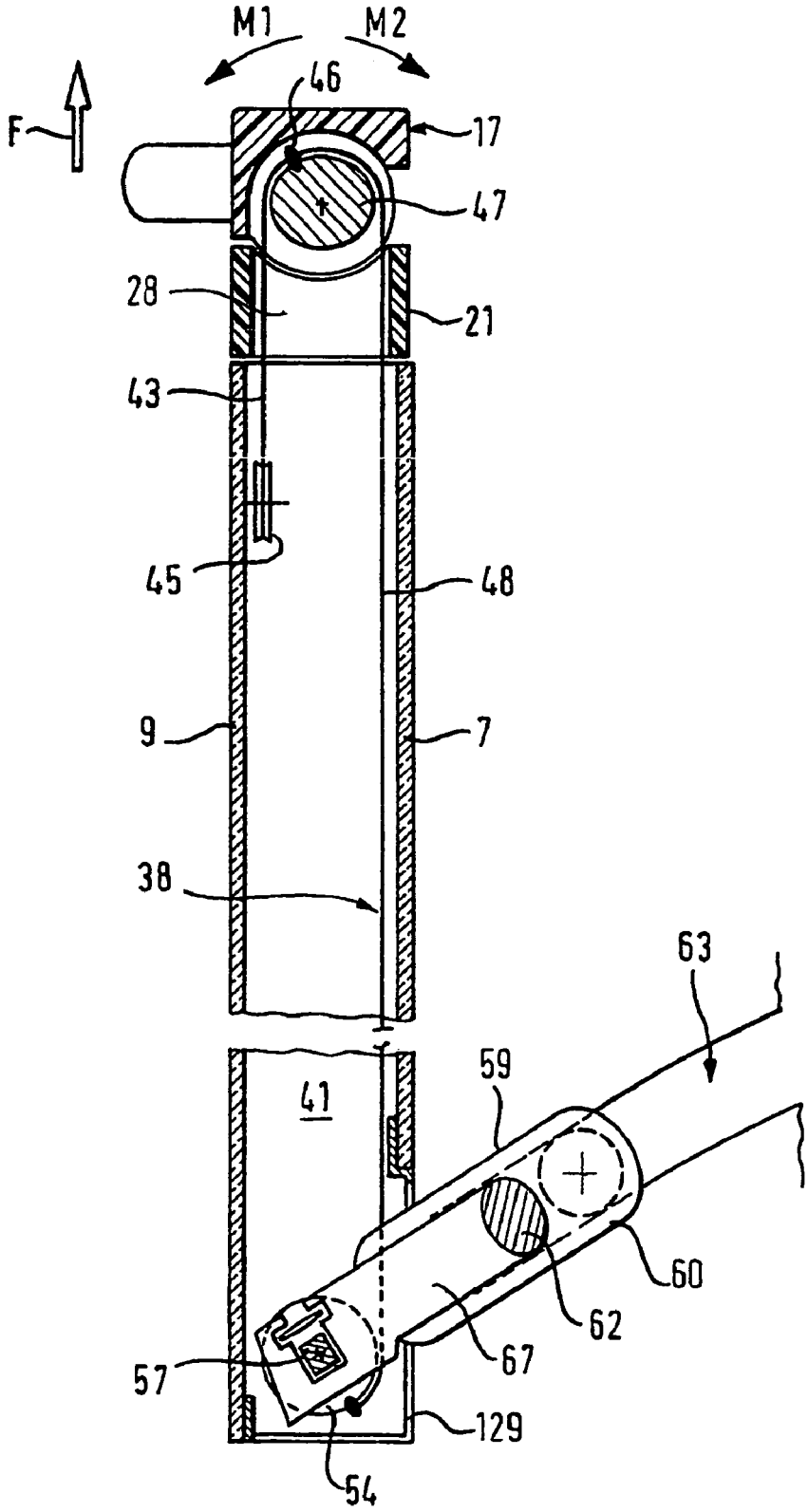
FIG. 4 is a fragmentary, side cross-sectional view of the door handle of FIG. 1 along section line B—B.

The two ends of the tension spring 39 are connected in each case through a first tension cable 43 to the pivoting part 16 to transmit a tension spring force to the pivoting part 16. The first tension cables 43 are guided through deflecting rollers 45, which are mounted rotatably on the stiffening elements 27, to radial cam plates 47. The radial cams 47 are connected on both sides in a rotationally fixed manner to the longitudinal ends of the pivoting part 16. Each of the first pulling cables 43 here is fixed on the circumference of the cam plate 47 at a fastening point 46. As a result, the tension spring 39 pre-stresses the door handle 17 against the first stop 35 and subjects the door handle 17 to a first torque Ml in a pivoting direction (FIG. 4). To protect against contamination, the radial cams 47 are disposed within lateral cutouts of the pivoting part 16. Covering sections 18 of the pivoting part 16 cover the cutouts on the end side.

A second tension cable 48 engages on the circumference of each of the radial cams 47. The second tension cable 48 is guided around the cam plate 47 in the direction counter to the first pulling cable 43 and is fixed on the circumference of the cam plate 47 at the fastening point 46. The first and second tension cables 43, 48 and the radial cams 47 form constituent parts of a control mechanism 38. The control mechanism 38 transmits a pivoting movement of the door 5 to the door handle 17, i.e., when the door 5 is pivoted in a first pivoting direction, the control mechanism 38 pivots the door handle 17 in a second pivoting direction, counter to the first pivoting direction. The construction and functioning of the control mechanism 38 are explained below with reference to FIG. 4.

FIG. 4 shows an upper and low cutout of the door 5 in a sectional illustration along the line B—B from FIG. 1. The door 5 is disposed in a closed position. A driving drum 54 that serves as a driving part of the control mechanism is disposed in the lower section of the door 5. Starting from the driving drum 54, a rotational movement is transmitted through the tension cable 48 to the radial cam 47. The tension cable 48 engages on the circumference of the radial cam 47. The tension cable 48, therefore, converts the rotational movement of the driving drum 54 into a rotational movement of the radial cam 47.

If the door 5 is pivoted downward from its closed position, which is shown in FIG. 4, the driving drum 54 rotates. The introduction of movement into the driving drum 54 is described later on with reference to the second exemplary embodiment. The rotational movement of the driving drum 54 is transmitted through the tension cable 48 to the radial cam 47, as a result, a second torque M2, which is directed counter to the first torque M1, is exerted on the door handle 17. The effect that can be achieved as a result is that the horizontal alignment of the door handle 17 that is shown in FIG. 4 is substantially retained regardless of the pivoting position of the door 5.

If an operator exerts an upwardly directed actuating force F on the door handle 17 shown in FIG. 4—for example, during transportation of the cooking appliance—the resultant pivoting movement of the pivoting part 16 of the door handle in the clockwise direction is absorbed by the tension spring 39. This prevents the pivoting movement of the door handle 17, which movement is directed in the clockwise direction, from being transmitted to the control mechanism 38. The tension spring 39 accordingly acts as a protective device that prevents damage to the control mechanism 38.

The starting point for dimensioning the spring force of the tension spring 39 or the torque M1 exerted as a result is a minimum value for the spring force of the tension spring 39. This minimum value corresponds approximately to the frictional forces that have to be overcome to reset the door handle 17 after an actuating force F is no longer exerted on the door handle 17. The tension spring 39 is dimensioned such that the abovementioned minimum value is approximately 10% to 20% of the spring force of the tension spring 39. The spring force of the tension spring 39 is, therefore, approximately five to ten times larger than this minimum value. If the door handle 17 is erroneously actuated, for example, by exertion of the upwardly directed actuating source F (see FIG. 4), damage to the control mechanism 38 is, thus, prevented. At the same time, the comparatively large spring force permits an ergonomically favorable operating feel during a normal opening or closing actuation of the door handle 17 by the operator.

Figure 5:
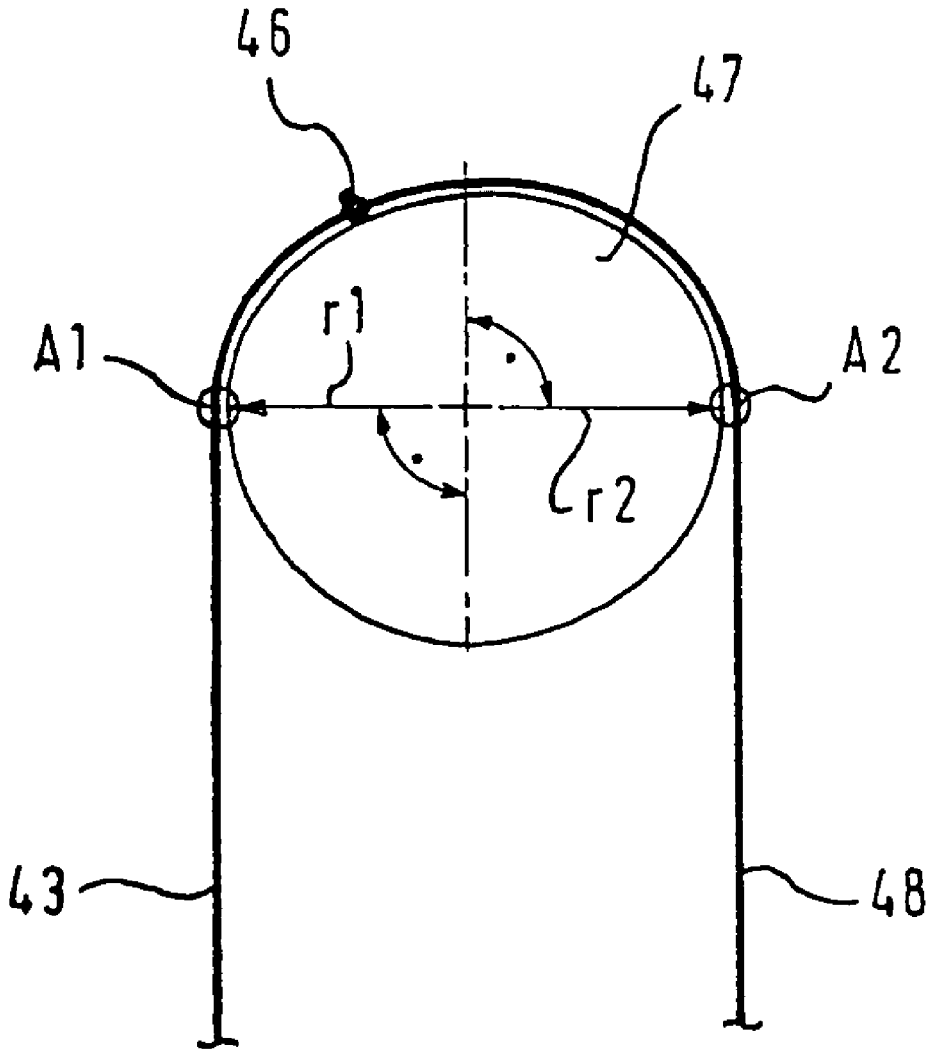
FIG. 5 is a diagrammatic, enlarged, cross-sectional view of a detail of the handle of FIG. 4.

To ensure that the rotational movement of the driving drum 54 is transmitted to the door handle 17 in a correct transmission ratio, the radius of the radial cam 47 is of great importance. The radius of the radial cam 47 determines, on one hand, the length of the lever arm and, therefore, the size of the torque with which the tension cables 43, 48 engage on the radial cam 47. On the other hand, the radius of the radial cam defines the transmission ratio at which a driving movement of the control mechanism 38 is converted into a pivoting movement of the door handle 17. In FIG. 5, the lever arm lengths r1, r2 of the radial cam 47, which lengths are associated with to the first and the second tension cable 43, 48, are configured such that they differ in size. FIG. 5 shows an enlarged illustration of the radial cam 47 from FIG. 4.

In FIG. 5, the points of action of the pulling cables 43 and 48 are designated A1 and A2. During an operation for opening the door 5, the point of action A1 of the pulling cable 43 moves through an angle of rotation of approximately 90° in the counterclockwise direction along the circumference of the cam plate 47. Over this angle of rotation, the lever arm length r1 is substantially constant. The torque M1 exerted on the door handle 17 is, therefore, constant during the pivoting movement of the door 5. At the same time, the engagement point A2 of the tension cable 48 moves through an angle of rotation section of approximately 90° in the counter-clockwise direction (with respect to FIG. 5) along the circumference of the radial cam 47. Over this angle of rotation, the lever arm length r2 is reduced during a pivoting movement of the door 5 from its closed position; that is to say, in the horizontal door position, the torque M2 exerted on the door handle 17 is the lowest possible. In the horizontal door position, the torque M2 counteracts a weight of the door 5; the weight of the door 5 keeps the door 5 stably in its horizontal position. The torque M2, which is reduced in the horizontal door position, is, therefore, not capable of compensating for the weight of the door. The stable position of the door in its horizontal position is, therefore, not adversely affected by the torque M2.

A radial cam 47 that is formed eccentrically enables the transmission ratio of the control mechanism 38 to be changed as a function of the pivoting position of the door 5. It is thus possible to compensate for drive losses of the control mechanism 38, which are produced, for example, at the beginning of a pivoting movement of the door as a result of expansion of the pulling cables 43, 48 or of play in the control mechanism 38.

Figure 6:
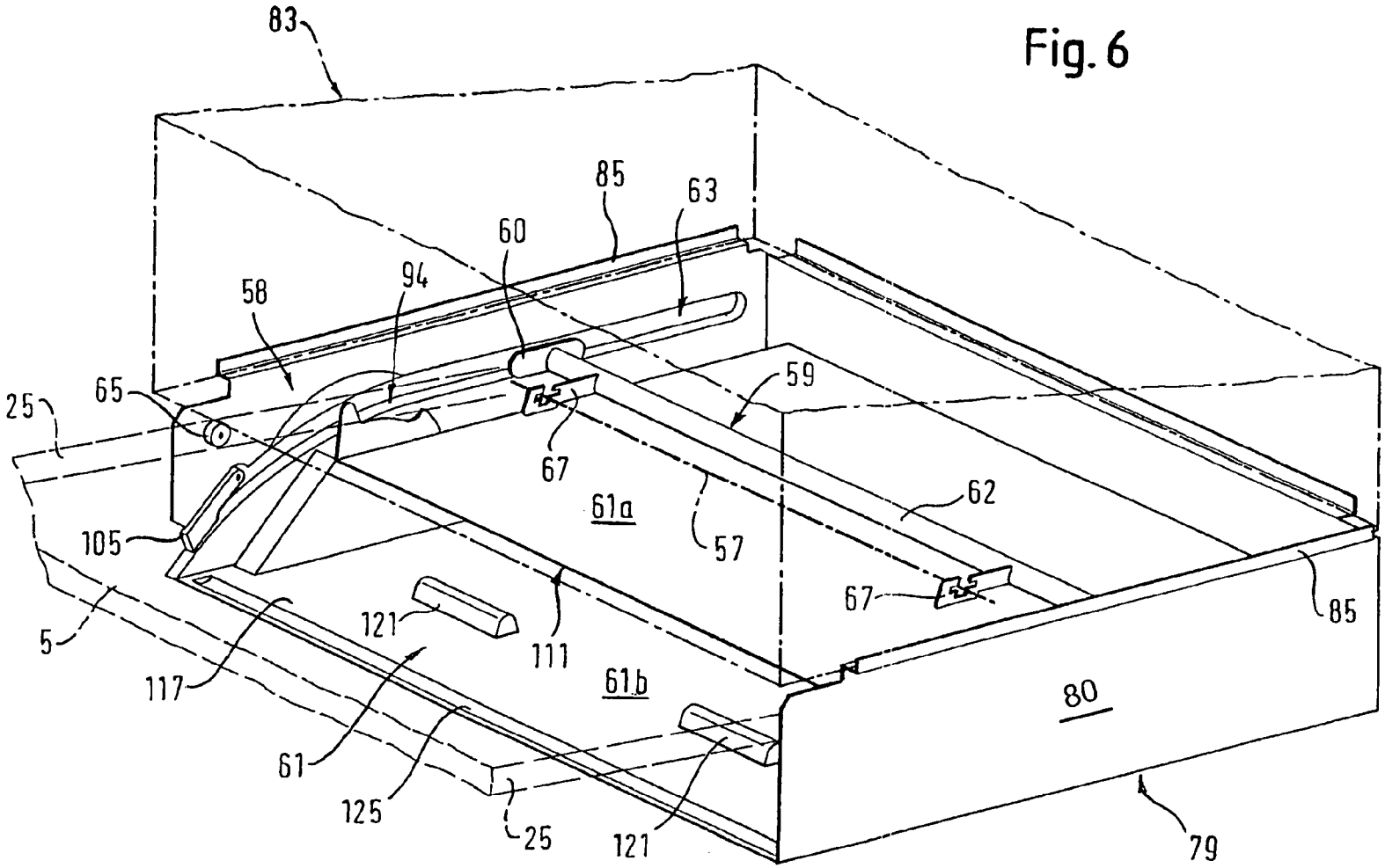
FIG. 6 is a fragmentary, perspective and partially hidden view of a second exemplary embodiment of a cooking appliance according to the invention.

FIG. 6 shows a cooking appliance according to a second exemplary embodiment of the present invention. The cooking appliance has a useful space module 83, which is indicated by a chain-dotted line and in which the cooking appliance muffle 3 (not illustrated) is disposed. A storage space module 79 is disposed below the useful space module 83. The storage space module 79 has a storage space 61 in which a guide system 58 for the door 5 is provided. The guide system 58 enables the cooking appliance door 5 (illustrated by dashed lines) to be displaced into the storage space module 79. According to FIG. 6, the storage space module 79 serves as a base or foundation on which the useful space module 83 is mounted. The storage space module 79 is configured as an upwardly open sheet-metal housing. Step-shaped abutment shoulders 85 are formed on the upper edge of the side walls 80 of the sheet-metal housing 79. The useful space module 83 rests on the contact shoulders 85 in a positionally correct manner, as indicated in FIG. 6. The operating and display elements 2, which are shown in FIG. 1, and an associated control unit are provided in the useful space module 83. The operating and display elements 2, here, together with the associated control unit, can function independently of the stowage-space module 79.

The control mechanism 38 of the second exemplary embodiment has, as driving part, a rotary shaft 57 on which the driving drum 54, which has already been mentioned in the first exemplary embodiment, is formed. The rotary shaft 57 is operatively connected to a guide element 59 of the guide system 58.

Figure 7:
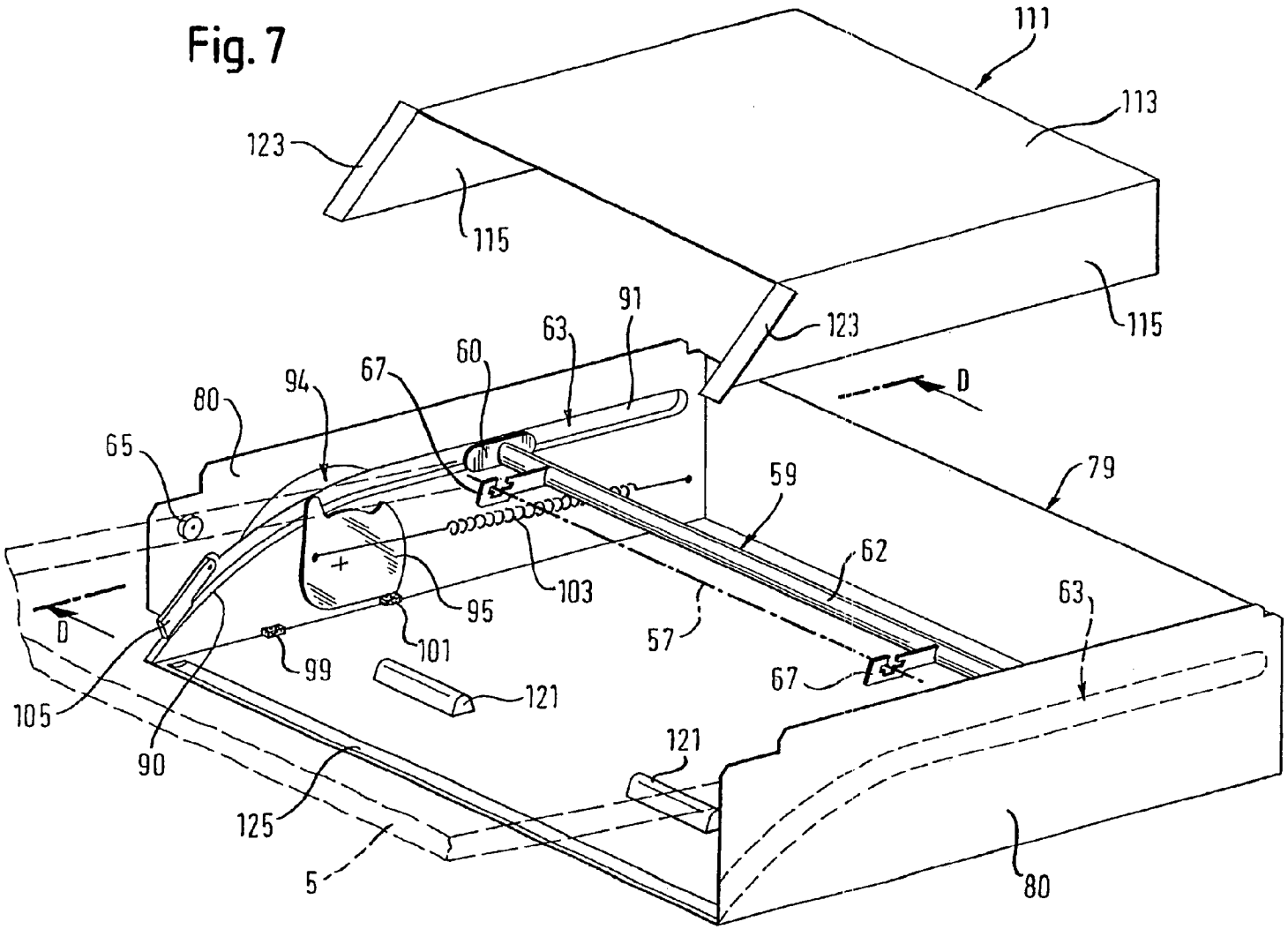
FIG. 7 is a fragmentary, perspective and partially hidden view of a storage space module of the cooking appliance of FIG. 6.

The construction and the functioning of the guide system 58 for the door 5 and the production of a drive movement for the control mechanism 38 is explained hereinbelow:

As illustrated in FIG. 6, the guide element 59 is part of the guide system 58, with the aid of which the door 5 is slid, during an opening process, into the storage space 61 provided below the cooking space 3. FIGS. 6 and 7 reveal that the guide system 58 has slotted-guide tracks 63. The slotted-guide tracks 63 are formed in the two opposite side walls 80 of the storage space module 79. The opposite slotted-guide tracks 63 guide sliders 60 of the guide element 59 therein. The sliders 60 are welded to each other through a connecting rod 62. The guide element 59 is, therefore, guided in the opposite slotted-guide tracks 63 in the manner of a guide carriage. Between the two sliders 60, adjusting levers 67 are welded to the connecting rod 62. As illustrated in the enlarged perspective cutout of FIG. 8, the adjusting levers 67 are connected in a form-fitting manner to the rotary shaft 57 of the control mechanism 58. The rotary shaft 57 is indicated in FIGS. 6 and 7 by chain-dotted lines.

Figure 8:
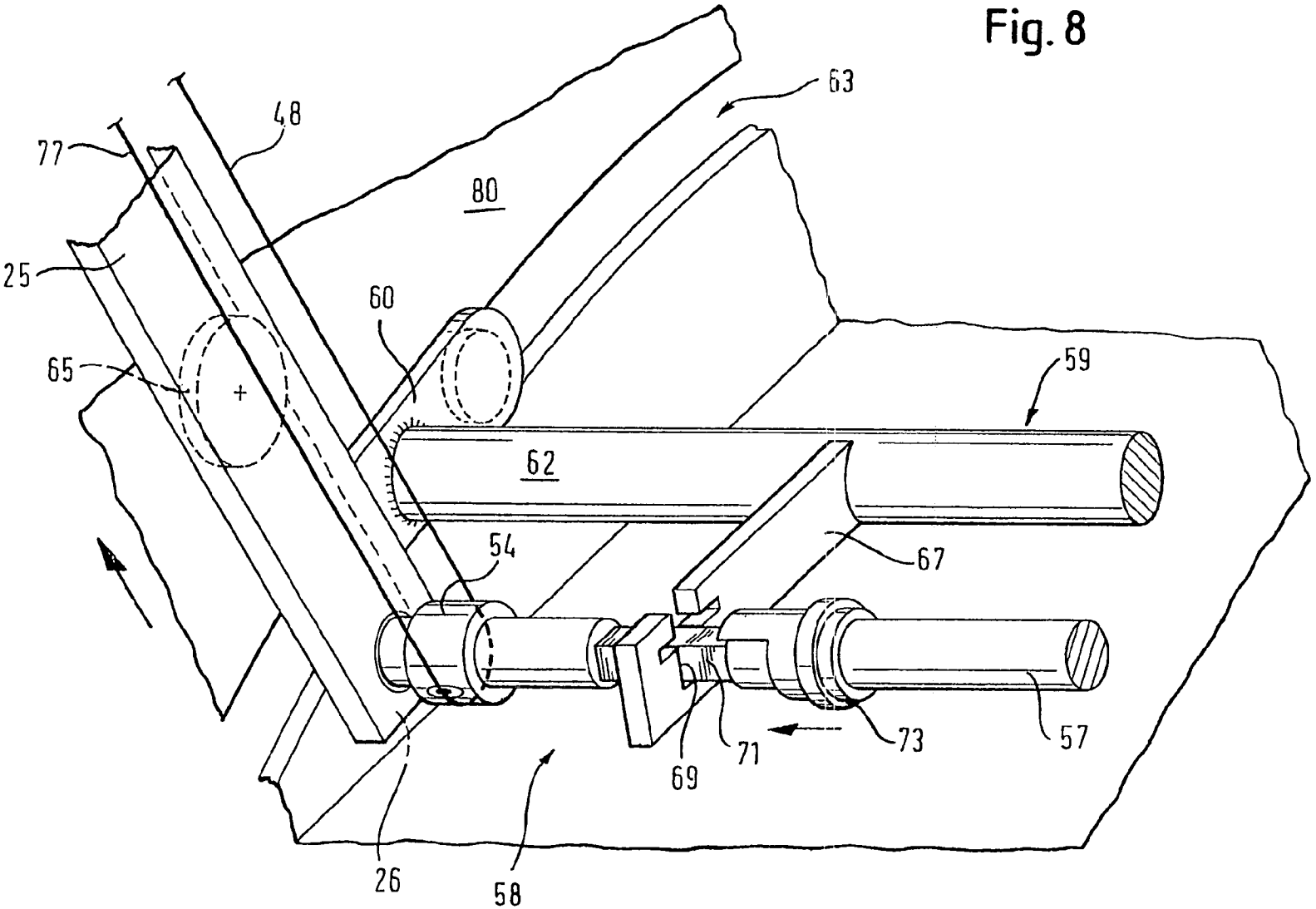
FIG. 8 is a fragmentary, enlarged, perspective view of a detail of the module of FIG. 7.

The above-mentioned form-fitting connection between the adjusting levers 67 of the guide carriage 59 and the rotary shaft 57 of the door 5 is illustrated in FIG. 8. The inner and outer door windows 7, 9 of the door 5 have been omitted from FIG. 8. Accordingly, the rotary shaft 57 is mounted rotatably in the opposite edge strips 25 of the door 5. For the form-fitting connection, the adjusting levers 67 of the guide carriage 59 each have a rectangular cutout 69 (FIG. 8). A corresponding, rectangular shape section 71 of the rotary shaft 57 is mounted in the cutout 69. The lateral edge strips 25 of the door 5 are provided in the outward direction in each case with a U-shaped groove that serves as a guide rail. In these guide rails 25, respective bearing rollers 65 are guided displaceably on both sides. The bearing rollers 65 are fastened to the side wall 80 of the storage space module 79. The U-shaped groove, which serves as a guide rail, is constructed on its lower end side with an open end 26. When the door is removed, as will be described at a later stage in the text, the housing-mounted bearing roller 65 can be released from the associated guide rail 25 by way of the open end 26.

Each of the opposite slotted-guide tracks 63 has a starting section 90 and a slide-in section 91. According to FIGS. 9A and 9C, an angle of inclination of the starting section 90 is approximately 45°. The starting section 90, furthermore, takes up approximately 30% of the entire length of the slotted-guide track 63 while the transition between the starting section 90 and the slide-in section 91 has a curved profile. The slide-in section 91 runs substantially in a horizontal plane. The bearing rollers 65, which are fixed on the housing, are disposed approximately level with the slide-in section 91 of the slotted-guide track 63.

Figure 9A:
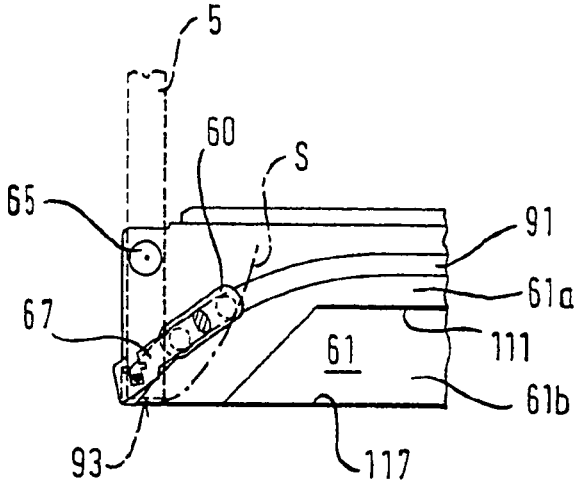
FIG. 9A is a fragmentary, side elevational and partially hidden view of a first part of an opening process of the mechanism of FIG. 8.
Figure 9B:
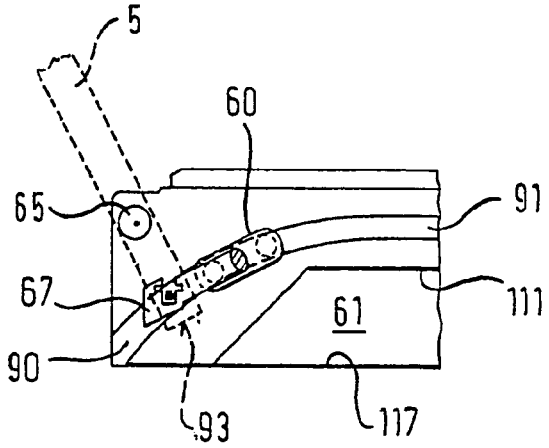
FIG. 9B is a fragmentary, side elevational and partially hidden view of a second part of an opening process of the mechanism of FIG. 8.
Figure 9C:
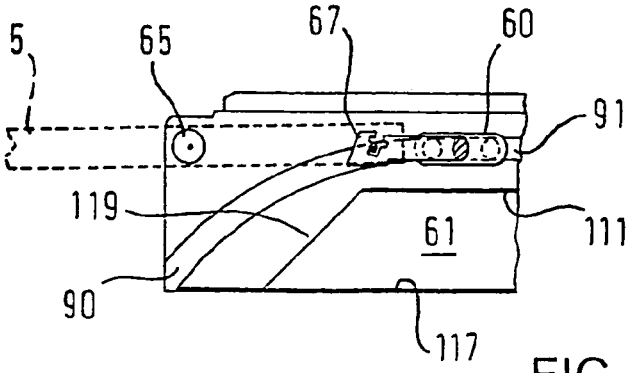
FIG. 9C is a fragmentary, side elevational and partially hidden view of a third part of an opening process of the mechanism of FIG. 8.

The course of movement of the guide carriage 59 of the door 5 in the slotted-guide tracks 63 is described with reference to FIGS. 9A to 9C. FIG. 9A shows the door 5 in its closed position. In the closed position, the sliders 60 of the guide carriage 59 are in the starting section 90 of the slotted-guide track 63. During an opening movement of the door 5 from its closed position shown in FIG. 9A, the sliders 60 of the guide carriage 59 are initially displaced upward. As a result, the adjusting levers 67 of the guide carriage 59 lift the door 5 upward. With this lifting movement of the door 5, a lower end side 93 of the door 5, which side pivots into the storage space 61, is displaced, at the same time, upward away from a base 117 of the storage space module 79, as is revealed in FIG. 9B. As a result, a pivoting region S of the lower end side 93, which region protrudes into the storage space 61 and is indicated by a chain-dotted line, is reduced. After the guide carriage 59 is moved from the starting section 90 into the horizontal slide-in section 91 (FIG. 9C), the door 5 is in a horizontal plane, in which it can be slid into the storage space 61. During the pivoting movement of the door 5, a pivoting angle between the door 5 and the guide block 59 changes. Because the rotary shaft 57 of the control mechanism 38 is mounted in a form-fitting manner in the adjusting levers 67 of the guide slide 59, the change in the pivoting angle between the door 5 and the guide carriage 59 causes a rotation of the rotary shaft 57. That is to say, during the pivoting movement of the door 5, the rotary shaft 57 is inevitably rotated by the guide element 59.

Figure 10:
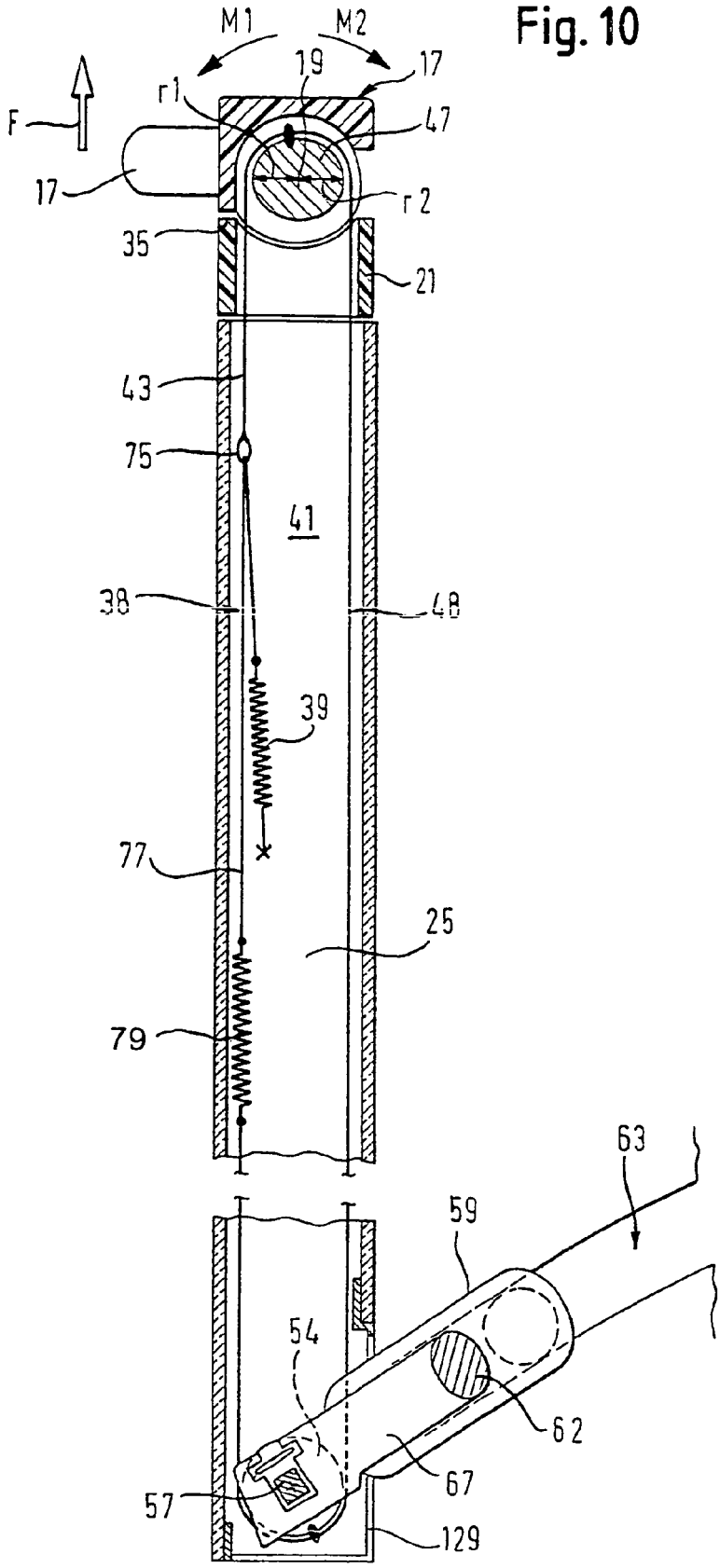
FIG. 10 shows a side sectional illustration of an upper and lower section of the door of the cooking appliance from FIG. 6.

The manner in which the control mechanism 38 transmits the inevitable rotation of the rotary shaft 57 to the door handle 17 is explained with reference to FIG. 10. FIG. 10 shows a side sectional view of the upper and lower section of the door 5 according to the second exemplary embodiment. This reveals that the adjusting lever 67 protrudes through an access opening 129 of the door 5 into the interior space 41 of the door and is connected in a form-fitting manner to the rotary shaft 57. As can be gathered from FIGS. 8 and 10, the rotary shaft 57 is configured with a driving drum 54, which is disposed in a rotationally fixed manner on the rotary shaft 57. The driving drum 54 is in engagement circumferentially with the tension cable 48. As in the first exemplary embodiment, the tension cable 48 is connected to the door handle 17.

During the pivoting movement of the door 5, a pivoting movement, therefore, arises between the guide carriage 59 and the door 5. As a result, the rotary shaft 57 is rotated inevitably. The rotational movement of the rotary shaft 57 is transmitted through the driving drum 54 to the tension cable 48. The tension cable 48 converts the rotational movement of the rotary shaft 57 into a rotational movement of the radial cam 47 and subjects the door handle to the second torque M2, which is directed counter to the first torque M1, on the door handle 17. The door handle 17, therefore, retains its horizontal alignment regardless of the pivoting position of the door 5.

In contrast to FIG. 4 of the first exemplary embodiment, in FIG. 10, the first tension cables 43, which engage on both sides on the radial cams 47 of the pivoting part 16 of the door handle 17, are not connected to a common-tension spring. Rather, according to FIG. 10, each of the first tension cables 43 is associated with a dedicated tension spring 39. The tension spring 39 is fastened at one end of the spring to the edge strip 25 of the door 5. The other end of the tension spring 39 is coupled to the tension cable 43 through a retaining eyelet 75. As a result, the door handle 17 is subjected to the first torque M1 in the counterclockwise direction.

The control mechanism 38 shown in FIG. 10 has a third tension cable 77. The third tension cable 77 is, on one hand, in circumferential engagement with the driving drum 54 of the rotary shaft 57 and is guided about the driving drum 54 in the opposite direction to the second tension cable 48. On the other hand, the third tension cable 77 is connected to the retaining eyelet 75 of the first tension cable 43. The first, second, and third tension cables 43, 48, 77 of the control mechanism 38 form a closed cable control that envelops the radial cam 47 and the driving drum 54 to transmit the rotational movement to the door handle 17.

To tighten the closed cable control 43, 48, 77, a tightening spring 79 is integrated in the third tension cable 77. The tightening spring 79 serves to tighten the closed cable control 43, 48, 77. In addition, the tightening spring 79 increases the torque M1 that is exerted by the tension spring 39 on the door handle 17. Therefore, both the tightening spring 79 and the tension spring 39 are present for exerting the torque M1. It is, therefore, advantageously possible for use to be made of two comparatively small springs that take up only a small amount of space in the limited inner space 41 of the door.

If the operator, for example, during transportation of the cooking appliance 1, exerts an upwardly directed actuating force F on the door handle 17 shown in FIG. 4, the resultant pivoting movement of the pivoting part 16 of the door handle in the clockwise direction is absorbed by the tension spring 39 and by the tightening spring 79. The resultant pivoting movement of the pivoting part 16 is, therefore, not transmitted from the door handle 17 to the control mechanism 38. As a result, damage to the control mechanism 38 is prevented.

The dimensioning of the spring force of the tension springs 39, 79 depend on the minimum value for the spring force, which value is specified in conjunction with FIG. 4.

Furthermore, the tension cables 43, 48, 77 can be provided with adjusting elements for adjusting a tensile stressing. By the adjusting elements, the tension cables provided on both sides of the door sides can be acted upon with an identical tensile stress. As a result, a synchronous operation of the two control mechanisms 38 is achieved.

A weight-balancing configuration 94 for the door 5 of the second exemplary embodiment is described below with reference to FIGS. 7, 11, and 12. During a movement of the door 5, the weight-balancing configuration 94 exerts a balancing force on the door 5, which force acts counter to the weight of the door 5. The weight of the door 5 is, therefore, not absorbed by the operator during a door movement, but, rather, by the weight-balancing configuration 94.

FIG. 7 shows, in a perspective view, the storage space module 79, of which a space divider 111 (described later on) is illustrated separately. On each of the opposite side walls 80, the weight-balancing configuration 94 has a pivoting lever 95. The pivoting lever 95 is mounted pivotally on the opposite side walls 80 through a lever spindle 97. FIG. 11 shows one of the side walls 80 in an enlarged side elevational view along the line D-D from FIG. 7. Accordingly, the pivoting lever 95 protrudes into the starting section 90 of the slotted-guide track 63 and is in engagement with the slider 60 of the guide carriage 59. A pivoting region of the pivoting lever 95 is configured such that the pivoting lever 95 is in engagement with the slider 60 of the guide carriage 59 only in the region of the starting section 90. By contrast, in the horizontal section 91, the pivoting lever 95 is disengaged from the slider 60 of the guide carriage 59. The pivoting lever 95 is connected to a tension spring 103. The tension spring 103 is fastened to the side wall 80. In FIG. 11, the tension spring 103 pre-stresses the pivoting lever 95 in the counter-clockwise direction.

Figure 11:
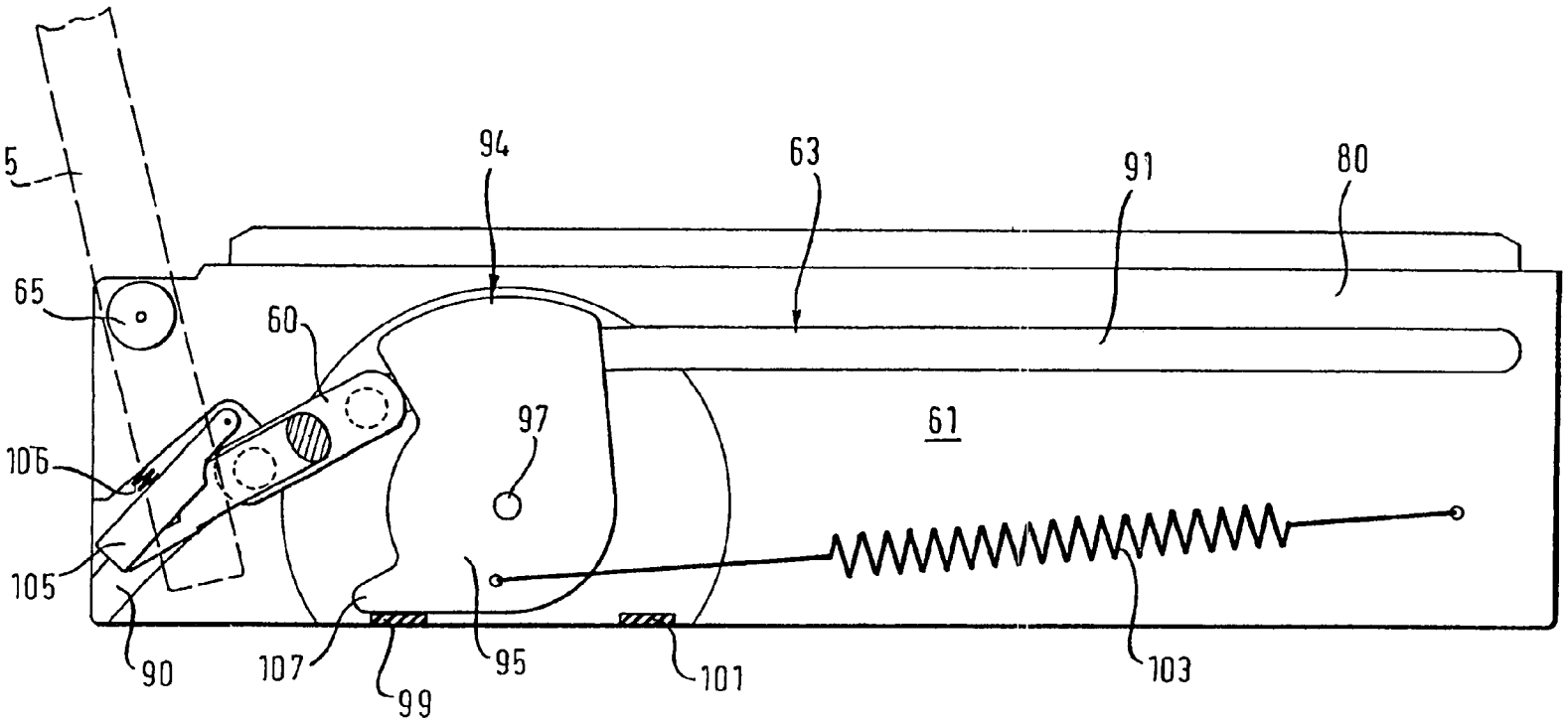
FIG. 11 is a side elevational view of the mechanisms of FIGS. 7 and 8 along line D—D in FIG. 7 in a first position.

When the door 5, which is illustrated by dashed lines in FIG. 11, is pivoted from its closed position downward into the horizontal position, the slider 60 runs from the starting section 90 into the horizontal section 91 of the slotted-guide track 63. During this movement, the slider 60 of the guide slide 59 presses against the spring-pre-stressed pivoting lever 95. The pivoting lever 95, therefore, subjects the sliding component 60 to a balancing force. The balancing force acts counter to the weight of the door 5.

As illustrated in FIG. 11, the pivoting lever 95 is pressed by the spring 103 against a first end stop 99, which is formed by a rubber support. In the position shown in FIG. 11, the pivoting lever 95 permits an initial movement of the slider 60 of the guide carriage 59 out of the closed position of the door 5. During this initial movement, the slider 60 does not engage with the pivoting lever 95. According to FIG. 11, the slider 60 comes into contact with the pivoting lever 95 only at a pivoting angle of the door 5 of approximately 20°. This simplifies the initial movement of the door 5 out of its closed position for the operator. Moreover, the pre-stressed pivoting lever 95 according to FIG. 11 acts as a stop against which the slider 60 of the guide carriage 59 strikes during the opening movement of the door 5. A certain pivoting position of the door 5 is, thus, signaled to the user. In the present case, this pivoting position corresponds to a removal position (described later on), in which a simple removal of the door 5 from the guide system 58 is made possible.

Furthermore, the weight-compensating configuration 94 has a pivotally mounted retaining element 105 that is pre-stressed by a spring 106. During the previously described initial movement of the door 5, the spring-pre-stressed retaining element 105 presses the slider 60 of the guide carriage 59 in the direction of the pivoting lever 95. As a result, the door 5 is retained stably in the removal position shown in FIG. 11.

Figure 12:
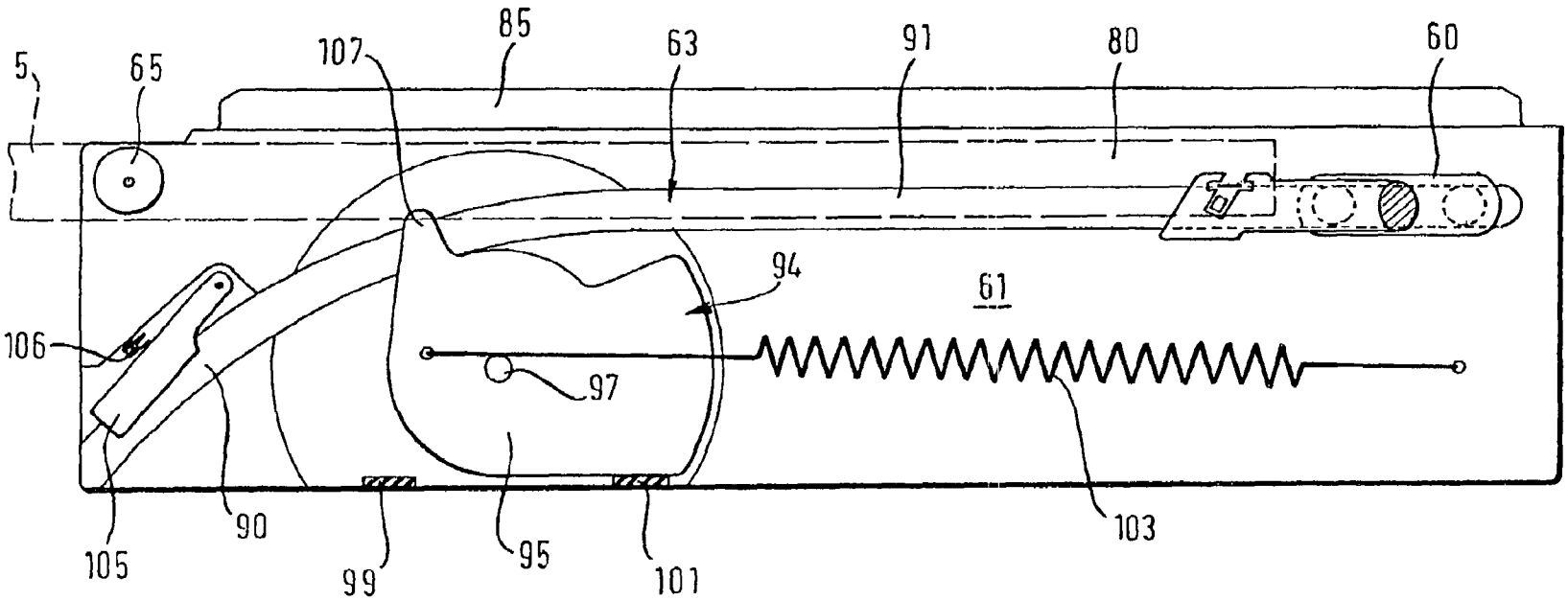
FIG. 12 is a side elevational view of the mechanism of FIG. 11 in a second position.

FIG. 12 shows the door 5 mounted horizontally and slid into the storage space 61. The slider 60 of the guide carriage 59 of the door 5 is in the horizontal slide-in section 91 of the slotted-guide track 63. During the movement of the slider 60 in the region of the slide-in section 91 of the slotted-guide track 63, the pivoting lever 95 is disengaged from the slider 60. The pivoting lever 95, therefore, does not exert any balancing force on the door 5. While the slider 60 runs in the slide-in section 91 of the slotted-guide track 63, the pivoting lever 95 is in the clockwise direction, by the spring 103, against a second end stop 101, which is, likewise, formed by a rubber support.

The pivoting lever 95 has a driver 107. The driver 107 of the pivoting lever 95 protrudes, in FIG. 12, into the slotted-guide track 63. According to FIG. 12, the slider 60 has been displaced from the starting section 90 into the slide-in section 91 of the slotted-guide track 63. The adjusting lever 95 is pre-stressed against the second end stop 101 and is in a holding position. When the door 5 is displaced out of the storage space 61, the slider 60 comes into engagement with the driver 107 of the pivoting lever 95. As a result, the pivoting lever 95 is brought out of its holding position and comes, once again, into a pressure contact with the slider 60 of the guide carriage 59. As a result, the pivoting lever 95 can, once again, exert the compensating force on the guide carriage 59 during a pivoting movement of the door 5.

The releasable mounting of the door 5 on the guide system 58 is explained below with reference to FIG. 8. Due to the releasable mounting of the door 5 in the guide system 58, the door 5 can easily be removed for cleaning. As already described with reference to FIG. 8, the adjusting levers 67 have a rectangular cutout 69. The corresponding rectangular shape section 71 of the rotary shaft 57 is mounted in the rectangular cutout 69. This produces a form-fitting connection between the guide carriage 59 and the rotary shaft 57. A locking element 73 that, according to FIG. 8, is mounted on the rotary shaft 57 is explained below. The locking element 73 can be displaced between a locking position and a release position. In the release position, the locking element 73 releases the mounting of the rotary shaft 57 in the adjusting lever 67. In a locking position of the locking element 73, the rotary shaft 57 is connected non-releasably to the adjusting lever 67.

The space divider 111 that is mentioned in conjunction with FIG. 7 is explained in the following text. As emerges, in particular, from FIG. 6, the space divider 111 is disposed in the storage space module 79. The space divider 111 divides the storage space 61 into a first storage space 61*a* and a second storage space 61*b*. The space divider 111 has a horizontal intermediate base 113 and side walls 115. The door 5 can be displaced into the first storage space 61*a*. The space divider 111 also separates the guide system 58, which is formed from the slotted-guide track 62 and guide carriage 59, and the weight-balancing configuration 94 from the second storage space 61b. Baking sheets or other accessories may be stored in the second storage space 61*b*.

As emerges from FIGS. 9A to 9C, the space divider 111 is disposed below the starting section 90 and the slide-in section 91 of the slotted-guide track 63. The intermediate base 113 together with the side walls 115 and a housing base 117 form an access opening 119. The latter is disposed spaced apart from the pivoting region S (indicated by a chain-dotted line) of the lower end side 93 of the door 5. Display elements 121 (FIGS. 7 and 8) are provided in the region of the access opening 119 of the second storage space 61*b*. The display elements 121 are configured as cams or protuberances that are fastened to the base 117 of the storage space 61. The display elements 121 indicate to the operator a maximum permissible length for objects that can be stored in the second storage space 61*b* without protruding into the pivoting region S of the lower end side 93 of the door 5. Appliance front-side panels 123 are formed on the side walls 115 of the space divider 111 (FIG. 7). The panels 123 serve for concealing the first storage space 61*a* from view. In addition, a collecting or drip channel 125 is provided in the housing base 117, in the region of the appliance front-side access opening 119, to keep the second storage space 61*b* free from contaminants, for example, dripping condensation water.

We claim:

1. A household appliance, comprising:

a body defining a useful space, a storage space, and a door opening;

a door pivotally connected to said body and selectively opening and closing off said door opening, said door having a door handle and a first pivoting direction;

at least one control mechanism operatively connected to said door handle to, during a pivoting of said door in said first pivoting direction, pivot said door handle in a second pivoting direction opposite to said first pivoting direction;

a guide system having:

a slotted-guide track connected to said body; and at least one guide element operatively associated with said door and guiding said door in said slotted-guide track; and said guide system guiding said door into and out from said storage space.

2. The household appliance according to claim 1, wherein said control mechanism operatively interacts with said guide element to transmit a movement of said guide element to said control mechanism.

3. The household appliance according to claim 2, wherein:

said guide element is a guide roller rolling in said slotted-guide track in a rotational movement; and said guide roller transmits said rotational movement to said control mechanism.

4. The household appliance according to claim 2, wherein:

said guide element pivots with respect to said door during a movement of said guide element in said slotted-guide track; and said guide element transmits said pivoting movement thereof to said control mechanism.

5. The household appliance according to claim 2, wherein said control mechanism has a driving part transmitting a movement to said control mechanism.

6. The household appliance according to claim 5, further comprising an adjusting lever formed on said guide element, said adjusting lever being in a form-fitting connection with said driving part of said control mechanism.

7. The household appliance according to claim 6, further comprising:

an adjustable locking element having a release position; and said control mechanism being associated operatively with said locking element and, in said release position of said locking element, said control mechanism releasing said form-fitting connection between said driving part of said control mechanism and said adjusting lever of said guide element.

8. The household appliance according to claim 1, further comprising:

a hinge pin fixed on said body;

said door being mounted pivotally about said hinge pin; and said door has at least one guide rail in which said hinge pin is guided.

9. The household appliance according to claim 1, wherein said slotted-guide track has a slide-in section by which said door is guided in a substantially horizontal plane.

10. The household appliance according to claim 9, wherein said hinge pin is disposed level with said slide-in section of said slotted-guide track.

11. The household appliance according to claim 1, wherein said control mechanism has at least one movement-transmitting device transmitting movement of said guide element to said door handle.

12. The household appliance according to claim 1, wherein control mechanism has a means for transmitting movement of said guide element to said door handle.

13. The household appliance according to claim 11, wherein said pivotable door handle has pivoting directions;

a spring prestresses said pivotable door handle in one of said pivoting directions and exerts a first torque on said door handle; and said movement-transmitting device exerts a second torque on said door handle, said second torque acting counter to said first torque.

14. The household appliance according to claim 13, wherein;

said door handle has a door handle spindle; and said control mechanism has, to exert said first torque, a first tension element connecting said spring element to said door handle and engaging on said door handle at a distance from said door handle spindle through a first lever arm length.

15. The household appliance according to claim 14, wherein said control mechanism has, to exert said second torque, a second tension element engaging on said door handle at a distance from said door handle spindle through a second lever arm length.

16. The household appliance according to claim 15, wherein at least one of said first and second lever arm lengths changes as a function of a pivoting position of said door handle.

17. The household appliance according to claim 15, wherein at least one of said first and second lever arm lengths is constant regardless of a pivoting position of said door handle.

18. The household appliance according to claim 15, wherein said control mechanism has at least one deflecting roller mounted on said door and defining a course of at least one of said first and second tension elements.

19. The household appliance according to claim 15, further comprising a radial cam guiding said first and second tension elements in opposite directions and being rotationally fixed to said door handle.

20. The household appliance according to claim 15, wherein said control mechanism has a tension element closed in the form of a loop and transmitting rotational movement from said driving part to said door handle.

21. The household appliance according to claim 20, wherein said control mechanism has a tightening device connected to said tension element and tightening said tension element.

22. The household appliance according to claim 20, wherein said control mechanism has a means for tightening said tension element.

23. The household appliance according to claim 1, wherein:

said door has two opposite narrow sides; and said control mechanism is two control mechanisms respectively provided on said two opposite narrow sides of said door.

24. The household appliance door according to claim 1, wherein the household appliance door is a cooking appliance door.

25. In a household appliance having an appliance body defining a useful space, a storage space, and a door opening, a door body comprising a door to be pivotally connected to the appliance body and to selectively open and close off the door opening, said door having a door handle and a first pivoting direction;

at least one control mechanism operatively connected to said door handle to, during a pivoting of said door in said first pivoting direction, pivot said door handle in a second pivoting direction opposite to said first pivoting direction;

a guide system having:

a slotted-guide track to be connected to the appliance body; and at least one guide element operatively associated with said door and guiding said door in said slotted-guide track; and said guide system configured to guide said door into and out from said storage space.

26. A household appliance, comprising:

a body defining a useful space, a storage space, and a door opening;

a door pivotally connected to said body and selectively opening and closing off said door opening, said door having a door handle and a first pivoting direction;

at least one control mechanism operatively connected to said door handle to, during a pivoting of said door in said first pivoting direction, pivot said door handle in a second pivoting direction opposite to said first pivoting direction;

a weight balancing mechanism operatively connected to the door for applying a force acting counter to a weight of the door for having the weight of the door absorbed thereby and not by an operator during a door movement;

a guide system having:

a slotted-guide track connected to said body; and at least one guide element operatively associated with said door and guiding said door in said slotted-guide track; and said guide system guiding said door into and out from said storage space.

27. The household appliance according to claim 26, wherein said weight balancing mechanism comprises:

at least one pivoting lever mounted on at least one side wall protruding into a starting section of the slotted guide track, with a pivoting region of said at least one pivoting lever in engagement with said at least one guide element; and at least one tension spring connected to the at least one pivoting lever and to at least one side wall to pre-stress the at least one pivoting lever in a direction opposing the weight of the door upon opening thereof.

* * * * *